US005107751A

United States Patent [19]

Grabner

[11] Patent Number: 5,107,751

[45] Date of Patent: Apr. 28, 1992

[54] CHUTE MAGAZINE FOR MODULAR PROPELLING CHARGES

[75] Inventor: Dieter Grabner, Willich, Fed. Rep. of Germany

[73] Assignee: Rheinmetall GmbH, Dusseldorf, Fed. Rep. of Germany

[21] Appl. No.: 579,598

[22] Filed: Sep. 7, 1990

[30] Foreign Application Priority Data

Sep. 19, 1989 [DE] Fed. Rep. of Germany ..... 3931192

[51] Int. Cl.[5] ..... F41A 9/70

[52] U.S. Cl. ..... 89/34

[58] Field of Search ..... 89/33.1, 34, 45

[56] References Cited

U.S. PATENT DOCUMENTS

| | | | |
|---|---|---|---|
| 2,790,356 | 4/1957 | Gerdin | 89/33.1 |
| 3,021,762 | 2/1962 | Soderqvist | 89/33.1 |
| 4,388,854 | 6/1983 | Dabrowski et al. | 89/34 |
| 4,706,544 | 11/1987 | Zielinski et al. | 89/46 |

FOREIGN PATENT DOCUMENTS

| | | | |
|---|---|---|---|
| 0207033 | 12/1986 | European Pat. Off. . | |
| 3437588 | 4/1986 | Fed. Rep. of Germany . | |
| 572504 | 10/1945 | United Kingdom | 89/33.1 |
| 572510 | 10/1954 | United Kingdom | 89/33.1 |
| 1138286 | 12/1968 | United Kingdom . | |

*Primary Examiner*—Stephen C. Bentley
*Attorney, Agent, or Firm*—Spencer, Frank & Schneider

[57] ABSTRACT

A chute magazine for storing and supplying modular propelling charges. A magazine floor is aligned in a direction in which the propelling charges are to be supplied and has a frontal end region formed as a collecting trough. A plurality of parallel chute walls are arranged at a right angle to the magazine floor and define a plurality of vertical chutes for the storage of superposed stacked rows of propelling charge modules. The chute walls have lower ends adjacent to and separated from the magazine floor to define a passage between the magazine floor and the adjacent ends and at right angles to the chute walls for supplying the propelling charge modules in a direction transversely to the chute walls into the trough. An automatically driven pusher is disposed in the passage above the magazine floor for pushing propelling charge modules disposed in the passage into the trough.

6 Claims, 2 Drawing Sheets

CHUTE MAGAZINE FOR MODULAR PROPELLING CHARGES

BACKGROUND OF THE INVENTION

The present invention relates to a chute magazine for storing and supplying modular propelling charges, and more particularly to a chute magazine which includes vertical chute walls for the storage of superposed stacked rows of propelling charge modules and a passage formed above the magazine floor by the chute walls for supplying the propelling charge modules transversely to their rows into a collecting trough.

German Patent No. 3,437,588.A1, corresponding to U.S. Pat. No. 4,706,544, discloses a chute magazine in which the propelling charge modules are guided into a removal position, for example, over a magazine floor set in an oblique plane. In order to prevent this propelling charge module transport from being dependent on an oblique position of the vehicle, it is necessary to limit the useful space and thus the packing density of the modules as a result of the space consuming inclination of the oblique plane of the magazine floor.

The same reference further discloses a control of the propelling charge module transporting mechanism within the magazine by way of a complicated lever mechanism, with a lever being associated with each propelling charge module stored in the oblique plane. Due to the fact that these individual levers must perform a blocking and transporting function for the propelling charge modules, it is not possible to transversely move the propelling charge modules disposed on the floor of the magazine into a collecting trough simultaneously but only successively.

SUMMARY OF THE INVENTION

It is an object of the present invention to provide a chute magazine for modular propelling charges which has a greater packing density and a very simple and rapid transporting arrangement for displacing the propelling charge modules stored in the chute magazines into a removal position.

The above and other objects are accomplished in accordance with the invention by the provision of a chute magazine for storing and supplying modular propelling charges, including: a magazine floor aligned in a direction in which the propelling charges are to be supplied and having a frontal end region formed as a collecting trough; a plurality of parallel chute walls arranged at a right angle to the magazine floor and defining a plurality of vertical chutes for the storage of superposed stacked rows of propelling charge modules, the chute walls having lower ends adjacent to and separated from the magazine floor to define a passage between the magazine floor and the adjacent ends and at a right angle to the chute walls for supplying the propelling charge modules in a direction transversely to the chute walls into the trough; and automatically driven pusher means disposed in the passage above the magazine floor for pushing propelling charge modules disposed in the passage into the trough.

Due to the fact that, according to the invention, the floor of the magazine is arranged at a right angle to the magazine chutes and the stored propelling charge modules are supplied independently of an oblique plane of the magazine floor, all vertical magazine chutes are able to accommodate the same number of propelling charge modules so that the dead volume of the entire magazine is reduced and its packing density is increased advantageously.

Preferably, the pusher means is in the form of a transverse pusher yoke which extends over the entire width of the magazine, so that all propelling charge modules disposed on the floor of the magazine can be displaced simultaneously and transported intermittently into the collecting trough.

Furthermore, the transverse pusher is preferably advantageously driven in a form locking manner by only a single drive assembly by way of a synchronous control on both sides of the magazine transversely to the stored propelling charge modules so that all propelling charge modules disposed on the floor of the magazine can be transported in parallel and in rows into the collecting trough.

The transverse transport of the propelling charge modules into the collecting trough is reliably effected in every position of the vehicle, particularly since the propelling charge modules to be displaced by the transverse pusher, before they are able to reach the collecting trough, are held in their position by a holding flap disposed immediately ahead of the collecting trough.

According to a further feature of the invention, one wall of each magazine chute is provided with a blocking lever which is disposed below the lowermost row of modules so that all propelling charge modules disposed in the lowermost rows of the chutes ar able to drop simultaneously onto the magazine floor for subsequent transverse displacement.

According to another feature of the invention, the collecting trough is disposed below the foremost vertical row of magazine chutes so that the time during the return movement of the transverse pusher can be utilized by directly supplying the lowermost row of propelling charge modules from the foremost chute into the collecting trough.

According to yet another feature of the invention, each propelling charge module disposed within a chute is fixed at its top by a blocking member which yields in the downward discharging direction so that each propelling charge module is supported in a stable manner; that is at the top, on the sides and at the bottom so that a secure arrangement is ensured, particularly during travel.

The invention will now be described in greater detail with reference to an embodiment thereof which is illustrated in the accompanying drawings.

DETAILED DESCRIPTION OF THE PREFERRED EMBODIMENT

Figure 1:
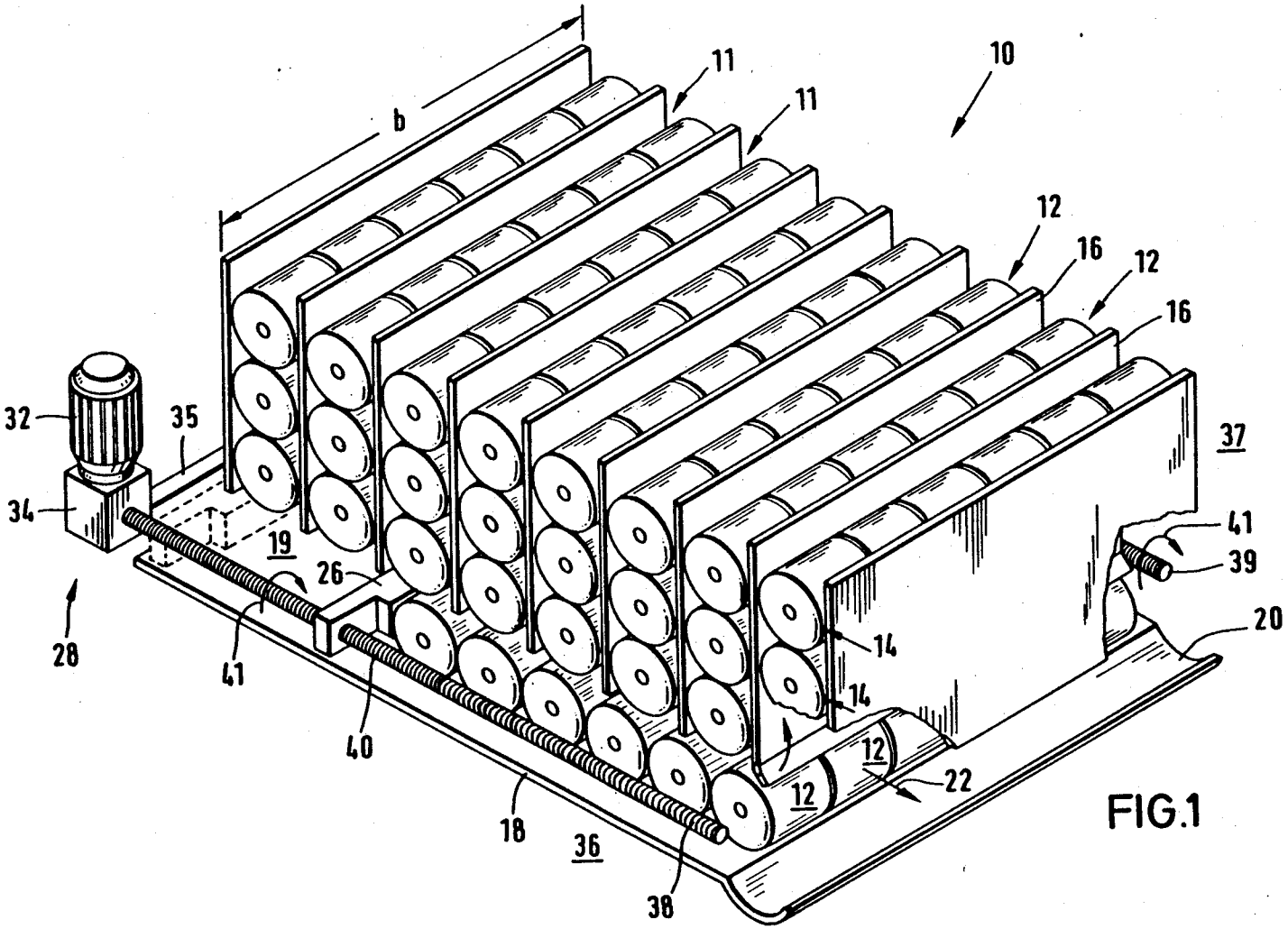
FIG. 1 is a perspective view of a chute magazine according to the invention.
Figure 2:
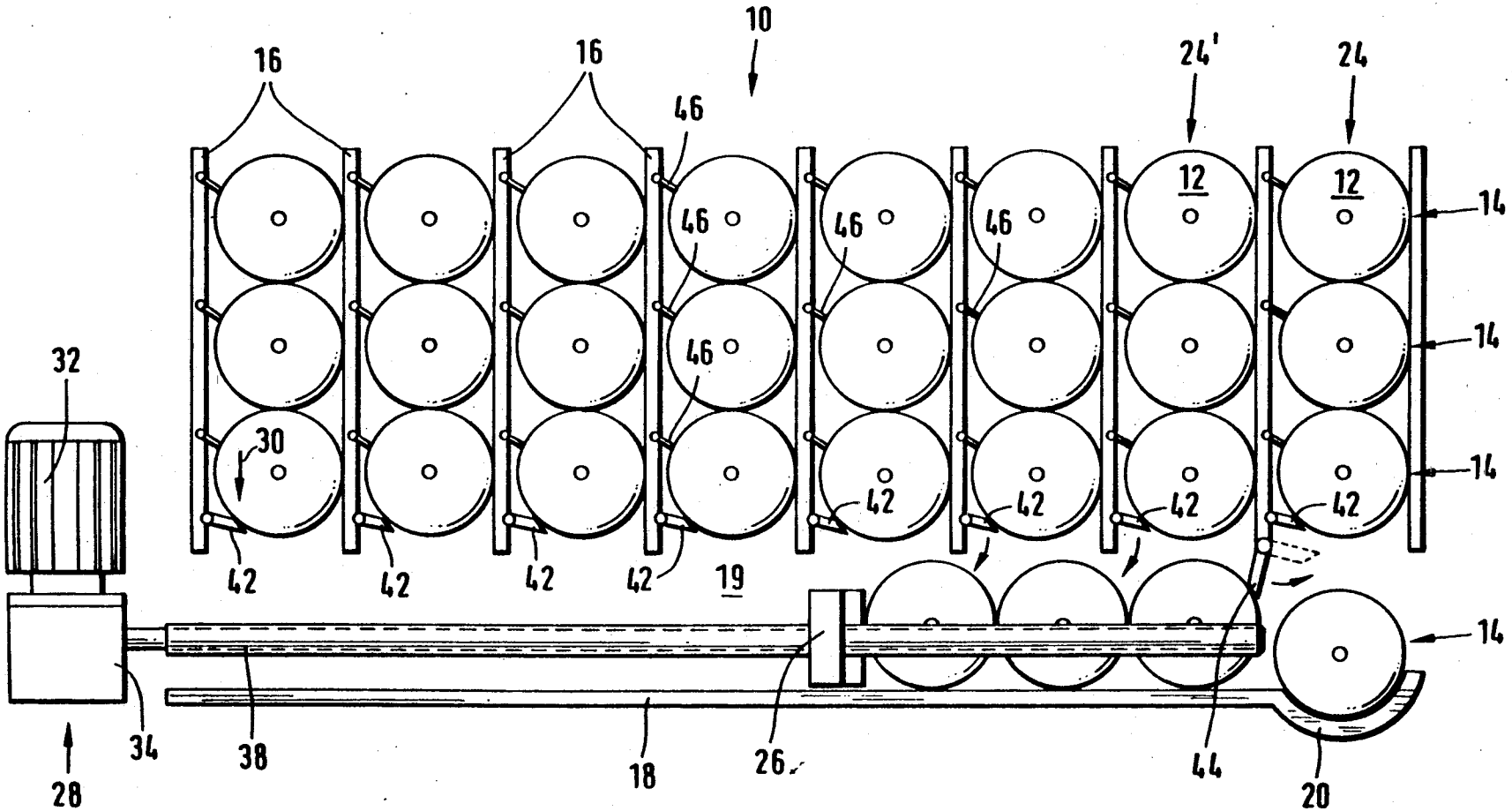
FIG. 2 is a side elevational view of the chute magazine shown in FIG. 1.

A chute magazine 10 according to the invention is shown in FIGS. 1 and 2 with its greatest possible load capacity. Chute magazine 10 constitutes a component in a system for the realization of rapid, reliable and fully automatic loading of modular propelling charges 12 from a storage position in chute magazine 10 to a chamber of a gun barrel (not shown).

Chute magazine 10 is preferably disposed in the turret (not shown) of an armored vehicle (not shown), from where the stored propelling charge modules 12 are supplied to the gun barrel by way of automatically controlled feeder units which are not part of the present invention.

The illustrated chute magazine 10 preferably includes eight parallel, juxtaposed magazine chutes 11 for the storage of propelling charge modules 12, with the chutes being separated from one another by vertical chute walls 16. Chute walls 16 are spaced from the floor 18 of the magazine to define a free passage 19 for moving propelling charge modules 12 into a collecting trough 20 formed in a frontal end region of magazine floor 18.

Magazine floor 18 is arranged at a right angle to chute walls 16 in a direction 22 in which propelling charge modules 12 are supplied so that all magazine chutes 11 are able to accommodate the same number of modules which are stacked one on top of the other in horizontal rows 14 to form respective chute rows 24, 24'.

In operation, propelling charge modules 12 of the row 14 of propelling charge modules in the lowermost plane initially drop in the direction toward magazine floor 18 from where they are brought in rows by an automatically driven transverse pusher 26 into collecting trough 20.

Transverse pusher 26 is arranged parallel to chute walls 16 and is composed of a yoke projecting beyond magazine width b and being connected in a form locking manner with an electrically controllable drive unit 28. Drive unit 28 is composed of at least one motor 32, which may be an electric motor or a hydraulic motor, a connected drive mechanism 34 and threaded spindles 38, 39 which are connected with the drive mechanism on each long side 36, 37 of the magazine, respectively. Each threaded spindle 38, 39 engages in an internally threaded bore 40 disposed at the end of transverse pusher 26. In order to ensure synchronous rotation 41, threaded spindle 39 disposed on the long side 37 of the magazine is connected by way of a shaft 35 that is connected with drive mechanism 34 and by way of a deflection gear (not shown). The manner in which transverse pusher 26 is driven, ensures a precise, intermittent advance of the propelling charge modules disposed on the magazine floor 18 in transporting direction 22.

Propelling charge modules 12 are held within magazine chutes 11 by controllable blocking flaps 42 which are each fastened below the lowermost row 14 of modules at one chute wall 16 of each chute 11 for controlling the release of the modules in the downward direction of arrow 30. Once transverse pusher 26 has moved back into its starting position, controllable blocking flaps 42 can be opened jointly to release the modules in the lowermost plane into passage 19. Thus, all module rows 14 disposed in the lower plane are available for transverse displacement into collecting trough 20. Moreover, flaps 42 play a decisive part in the free movement of propelling charge modules 12 within a magazine chute 11. For this reason, they are fastened in a space saving manner within chute walls 16.

In order to bridge the time lost during return of the pusher, the forward magazine chute 24 is configured as a buffer chute. It is disposed immediately above collecting trough 20 and is emptied in a controlled manner by way of a flap 42, whenever transverse pusher 26 moves back into its starting position (the far left in FIG. 2).

In order to prevent propelling charge modules 12 from dropping into the collecting trough 20 in an uncontrolled manner in the supply direction 22 and to supply them in an orderly manner, the chute wall 16 disposed between the frontal magazine row 24 and the adjacent magazine row 24' is additionally provided with a yielding holding flap 44. Holding flap 44 may be spring tensioned in a manner not shown and may be pivoted out of the way during the transverse displacement of propelling charge modules 12 and spring back after the frontal row of modules has entered collecting trough 20 to perform the holding function.

In order to prevent propelling charge modules 12 disposed in chute magazine 10 from bursting, for example during travel of the armored vehicle in which the magazine is disposed, blocking members 46, which yield in the discharge direction 30, are disposed at one wall 16 of each chute 11, above each module 12 in each of the rows 14. Propelling charge modules 12 are thus securely held not only from the bottom by blocking flap 42 and o the sides by chute walls 16, but also on the top by blocking members 46. After removal of the lowermost level of propelling charge modules, blocking members 46 ensure that the other propelling charge modules slide down by their own weight. Blocking members 46 are spring biased (not shown) and are also stored in a space saving manner within the confines of chute wall 16.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A chute magazine for storing and supplying modular propelling charges, comprising:

a magazine floor aligned in a direction in which the propelling charges are to be supplied and having a frontal end region formed as a collecting trough;

a plurality of parallel chute walls arranged at a right angel to said magazine floor and defining a plurality of vertical chutes for the storage of superposed stacked rows of propelling charge modules, said chute walls having lower ends adjacent to and separated from said magazine floor to define a passage between said magazine floor and said adjacent ends and at a right angle to said chute walls for supplying the propelling charge modules in a direction transversely to the chute walls into said trough; and automatically driven pusher means disposed in said passage above said magazine floor for pushing propelling charge modules disposed in said passage into said trough, wherein said chute magazine has a width, and said pusher means comprises a yoke arranged parallel to said chutes and projecting beyond the width of said chute magazine and controllable drive means having a form locking connection with said yoke on both sides of said chute magazine for controllably driving said yoke for pushing the propelling charge modules.

2. A chute magazine as defined in claim 1, wherein said chute magazine has parallel long sides, said yoke has opposite ends each having an internally thread bore and said drive means comprises at least one motor, a drive mechanism operatively coupled with said motor, and two threaded spindles disposed along the respective long sides of said chute magazine, each threaded spindle operatively connected with said drive mechanism and engaging a respective one of the internally threaded bores of said yoke.

3. A chute magazine as defined in claim 1, further comprising a plurality of blocking flap means each connected at one wall of each chute below a lowermost row of modules for controllably releasing the propelling charge modules into said passage.

4. A chute magazine as defined in claim 1, wherein said plurality of chutes includes a foremost chute disposed above said trough.

5. A chute magazine as defined in claim 4, further comprising holding flap means attached to the chute wall disposed between said foremost chute and the chute immediately adjacent to said foremost chute for holding the propelling charge modules in position before they are to be pushed into said trough by said pusher means.

6. A chute magazine as defined in claim 1, further comprising blocking members attached at one wall of each chute above each module, said blocking members yielding in a direction in which the modules are discharged toward said passage.

* * * * *